252-105 AU 157 EX
5/22/84 XR 4,450,083

United States Patent [19]
Streit et al.

[11] 4,450,083
[45] May 22, 1984

[54] AGENT FOR DISSOLVING INSOLUBLE IRON(III) COMPOUNDS IN HIGHLY ALKALINE TEXTILE TREATMENT LIQUORS

[75] Inventors: Werner Streit, Bobenheim; Klaus Lorenz, Worms; Norbert Leppert, Speyer, all of Fed. Rep. of Germany

[73] Assignee: BASF Aktiengesellschaft, Ludwigshafen, Fed. Rep. of Germany

[21] Appl. No.: 472,207

[22] Filed: Mar. 4, 1983

[30] Foreign Application Priority Data

Mar. 19, 1982 [DE] Fed. Rep. of Germany ..... 3210004

[51] Int. Cl.[3] ..... D06L 3/10; B08B 3/00
[52] U.S. Cl. ..... 252/8.6; 252/105; 423/139
[58] Field of Search ..... 252/188.1, 105, 8.6; 423/139

[56] References Cited

U.S. PATENT DOCUMENTS

| | | | |
|---|---|---|---|
| 3,183,191 | 5/1965 | Hach | 252/105 |
| 3,515,673 | 6/1970 | Kersnar et al. | 8/137 |
| 3,666,446 | 5/1972 | Cook et al. | 423/139 |
| 3,732,171 | 5/1973 | Kuhajek et al. | 252/105 |
| 4,124,543 | 11/1978 | Azuma et al. | 252/8.6 |
| 4,195,974 | 4/1980 | Kothe et al. . | |
| 4,317,804 | 3/1982 | Ichijo | 423/150 |

FOREIGN PATENT DOCUMENTS

| | | | |
|---|---|---|---|
| 489800 | 1/1953 | Canada | 252/105 |
| 1042165 | 10/1958 | Fed. Rep. of Germany . | |
| 1546118 | 9/1972 | Fed. Rep. of Germany | 252/105 |
| 2935793 | 3/1981 | Fed. Rep. of Germany | 423/139 |
| 52-27401 | 3/1977 | Japan | 252/105 |
| 1591616 | 6/1981 | United Kingdom | 8/137 |

*Primary Examiner*—Maria Parrish Tungol
*Attorney, Agent, or Firm*—Oblon, Fisher, Spivak, McClelland & Maier

[57] ABSTRACT

An agent, based on reducing agents and complexing agents, for dissolving insoluble iron(III) compounds in aqueous textile treatment baths which are at a pH of 10 or more, which agent has the following composition:

(a) from 4 to 65% by weight of one or more water-soluble hydroxycarbonyl compound or of an N- or O-acetal thereof, as the reducing agent,
(b) from 10 to 80% by weight of one or more complexing agent which complexes $Fe^{++}$ ions at a pH of 10 or more and
(c) water in an amount equal to 100% minus the amounts of (a) and (b).

3 Claims, No Drawings

AGENT FOR DISSOLVING INSOLUBLE IRON(III) COMPOUNDS IN HIGHLY ALKALINE TEXTILE TREATMENT LIQUORS

In the pretreatment of cotton or other cellulosic textile goods, a problem commonly encountered is that, because these treatment steps are carried out in a highly alkaline medium, ie. at a pH of 10 or more, iron(III) hydroxide or $Fe_2O_3$ precipitates on the fabric and forms rust spots. Rust spots are also produced on the fabric due to the production method, namely caused by metal abrasion during weaving or caused by metal packaging straps. These precipitates, hereafter referred to, for simplicity, as rust, can, during the subsequent peroxide bleach, lead to severe catalytic damage, ie. to holes in the fabric.

It is known that in an alkaline medium divalent iron can be complexed more easily at relatively high concentration than trivalent iron. This can be explained in terms of the extremely low solubility of iron(III) hydroxide. The solubility product of $Fe(OH)_2$ depends only on the square and not, as in the case of $Fe(OH)_3$, on the cube of the OH ion concentration.

For this reason, inorganic reducing agents have hitherto been added to the textile treatment liquors.

German Published Application DAS No. 1,042,165 (Example 2) discloses that, for example, a mixture of sodium dithionite, triethanolamine, sodium citrate, anionic wetting agent and a soft-ceresine may be used as a rust remover for textile goods.

German Published Application DAS No. 2,735,816 discloses a process for bleaching and desizing cellulosic textile goods, wherein a mixture of sodium dithionite, an aminopolycarboxylic acid, eg. ethylenediaminetetraacetic acid, and a buffer is employed as a heavy metal complexing agent, ie., inter alia, as an iron complexing agent.

Disadvantages of these methods are, first, the unavoidable formation of sulfites, which passs into the effluent and, as is known, severely pollute the environment, and, secondly, the fact that even at a high pH of 10 or more the effect achieved is still inadequate.

It is an object of the present invention to provide an agent which even at a high pH, such as is necessary in alkaline pretreatment processes in the textile industry, reduces iron(III) compounds and immediately converts the resulting iron(II) compound into a stable, soluble iron complex, which even air in the pretreatment liquor, and prolonged standing, do not render insoluble. It is a further object of the invention to provide an agent for the said purpose, which does not lead to harmful products in the effluent.

We have found that these objects are achieved by providing agents as defined in claims 1 and 2.

We have found that water-soluble hydroxycarbonyl compounds or their N- or O-acetals have, at a pH of 10 or more, a redox potential which suffices to reduce trivalent iron to divalent iron.

The hydroxycarbonyl compound (component a) may be an aldehyde or a ketone. The only precondition is that it should be water-soluble under the prevailing process conditions and carry a hydroxyl group in the α-position to the carbonyl group. The carbonyl group can also be N- or O-acetalized. These compounds include, for example, glycolaldehyde, glycerolaldehyde, dihydroxyacetone, hydroxyacetone and their simple O- and N-acetals, as well as monosaccharides, such as glucose, galactose, tylose and fructose, which may be in their hemiacetal form or may have been reacted with amines such as diethanolamine (N-acetal), and the disaccharides and polysaccharides which are bonded in an acetal-like (glucosidic) manner and are water-soluble, such as sucrose and starch. The preferred components (a), because of being particularly easily obtainable, are glucose or fructose and their reaction products with amines, eg. diethanolamine.

Component (b) is the complexing agent. This may be any compound which is capable of bonding $Fe^{++}$ ions, to a significant degree, in the form of a stable complex at a pH of 10 or more, and thereby preventing precipitation of $Fe(OH)_2$).

Examples of such compounds include gluconic acid, sorbitol, triethanolamine, hydroxyethanediphosphonic acid or adducts of polyalkylenepolyamines with from 2 to 10 moles of an alkylene oxide, preferably adducts of polyethyleneimine, containing from 2 to 6 recurring ethyleneimine units, with from 2 to 10 moles of ethylene oxide or propylene oxide. Other well-known complexing agents, such as aminopolycarboxylic acids, are no longer sufficiently active under these pH conditions.

The formulation contains from 4 to 65, preferably from 10 to 35,% by weight of component (a) and from 10 to 80, preferably from 25 to 60, % by weight of component (b), the remainder being water.

In addition to the agents according to the invention, dispersants may also be used, in amounts of up to 25% by weight based on the formulation; particular examples are polyacrylic acid, copolymers of acrylic acid and maleic acid, polymaleic acid and maleic anhydride/vinyl ether copolymers.

The agents are especially employed in the pretreatment of textile goods consisting of, or containing, cellulose. In addition to the conventional constituents, the alkaline treatment liquors contain, based on the liquor, and assuming a liquor ratio of 1:1, from 0.2 to 15, preferably from 0.3 to 12, % by weight of the agents according to the invention.

The Examples which follow illustrate the invention.

The ability of the mixtures to dissolve iron hydroxide precipitates was tested as follows. A defined amount of iron hydroxide precipitate was produced in a sodium hydroxide solution of a defined concentration, by adding from 1 to 10 ml of a 10% strength solution of $FeCl_3.6H_2O$ in water. The precipitate was then left to stand for 60 minutes at 50° C. Thereafter, the mixtures claimed were added to the sodium hydroxide solutions at 80°–90° C. and the time required for the precipitate to dissolve was recorded.

EXAMPLE 1

A mixture was prepared from:

37.5% of 50% strength gluconic acid in $H_2O$
12.5% of glucose monohydrate
50% of triethanolamine An iron hydroxide precipitate (~159 mg) was produced in 200 ml of a 10% strength sodium hydroxide solution with 4 ml of the 10% strength $FeCl_3.6H_2O$ solution. It proved possible to dissolve this precipitate within 30 minutes at 80° C. by adding 1.0 g of mixture 1. On adding 2 g of the mixture, the precipitate dissolved within 4 minutes. If the concentration of the sodium hydroxide solution was reduced to 5%, it was necessary to add 1.25 g of mixture 1 to dissolve the same amount of $Fe(OH)_3$ precipitate after 30 minutes at 80° C.

| Sodium hydroxide solution Concentration in % | Dissolution time in min. | Amount of mixture 1 added, in g/200 ml |
|---|---|---|
| 10 | 30 | 1.0 |
| 10 | 4 | 2.0 |
| 5 | 30 | 1.25 |
| 5 | 3.5 | 2.5 |

EXAMPLE 2

A mixture of

63% of 50% strength gluconic acid

13% of ethylenediamine reacted with 4 moles of propylene oxide and

24% of 70% strength hydroxyacetone in $H_2O$ was used.

79 mg of $Fe(OH)_3$ precipitate were produced in 200 ml of 8% and 4% strength sodium hydroxide solutions with 2 ml of the 10% strength $FeCl_3.6H_2O$ solution. The dissolution experiment was carried out at 90° C.

| Sodium hydroxide solution Concentration in % | Dissolution time in min. | Amount of mixture 2 added, in g/200 ml |
|---|---|---|
| 8 | 15 | 2.5 |
| 8 | 5 | 3.2 |
| 4 | 15 | 2.9 |
| 4 | 5 | 4.0 |

EXAMPLE 3

A mixture of

34% of 50% strength gluconic acid in $H_2O$,

8% of ethylenediamine reacted with 4 moles of propylene oxide,

8% of diethylenetriamine reacted with 5 moles of ethylene oxide,

24% of dextrose and

26% of 50% strength polyacrylic acid in $H_2O$ (K value 10–13)

was used.

59 mg of $Fe(OH)_3$ precipitate were produced in 200 ml of 6% and 3% strength sodium hydroxide solutions with 1.5 ml of the 10% strength $FeCl_3.6H_2O$ solution.

The dissolution experiment was carried out at 90° C.

| Sodium hydroxide solution Concentration in % | Dissolution time in min. | Amount of mixture 3 added, in g/200 ml |
|---|---|---|
| 6 | 15 | 2.9 |
| 6 | 5 | 4.0 |
| 3 | 20 | 3.0 |
| 3 | 7.5 | 4.0 |

EXAMPLE 4

A mixture of 37.5% of 50% strength gluconic acid, 22.5% of a reaction product of glucose with diethanolamine (see below) and 40% of triethanolamine was used.

The iron hydroxide dissolving ability was tested as in Example 1; 2.5 ml of 10% strength $FeCl_3.6H_2O$ solution were added to the dilute alkali (200 ml).

| Sodium hydroxide solution Concentration in % | Mixture added, in g per 200 ml | Dissolution time in min. |
|---|---|---|
| 4 | 1.5 | 17 |
| 8 | 1.5 | 14 |
| 12 | 1.5 | 12 |

The ability of the mixtures to detach and dissolve rust present on cotton fabric was also tested. For this purpose, cotton cloth was impregnated with water which had been brought to pH 9.5 by adding sodium hydroxide solution, and was then squeezed off. 1 drop (20 drops=1 ml) of 5% strength $FeCl_3.6H_2O$ was then applied to each of three positions The cloth was then sprayed again with alkaline water and dried at room temperature for not less than 48 hours. Rust spots of about 2 cm diameter were formed on the fabric.

EXAMPLE 5

The fabric with rust spots was introduced into 6% and 10% strength sodium hydroxide solution at 85° C., using a long liquor (liquor ratio 40:1). 3 g/liter of a wetting agent were added to the liquors beforehand. On adding 5 g of the mixture from Example 1 per liter of liquor, all rust spots were removed in both cases; similar results were achieved in 12% strength sodium hydroxide solution.

| Sodium hydroxide solution Concentration in % | Dissolution time in min. | Amount of mixture 1 added, in g/liter |
|---|---|---|
| 4 | 6.5 | 5 |
| 6 | 5.5 | 5 |
| 10 | 5.2 | 5.8 |
| 12 | 2 | 8 |

EXAMPLE 6

The fabric with rust spots was impregnated with a liquor which consisted of 8% strength sodium hydroxide solution and to which 4 g/liter of wetting agent and 70 g/liter of the mixture from Example 2 had been added. It was then squeezed off to a wet pick-up of 100%.

The moist fabric was treated in a steamer at 103° C. for one minute and then washed for 90 seconds at 50° C. All rust spots were removed.

We claim:

1. An aqueous formulation, based on reducing agents and complexing agents, for dissolving insoluble iron(III) compounds in aqueous textile treatment baths which are at a pH of 10 or more, which formulation has the following composition:

(a) from 4 to 65% by weight of one or more water-soluble hydroxycarbonyl compound or of an N- or O-acetal thereof, as the reducing agent, (b) from 10 to 80% by weight of one or more complexing agent which complexes $Fe^{++}$ ions at a pH of 10 or more and (c) water in an amount equal to 100% minus the amounts of (a) and (b).

2. An agent as claimed in claim 1, wherein component (a) is hydroxyacetone, glucose, sucrose or their N- or O-acetals and component (b) is gluconic acid, sorbitol, hydroxyethanediphosphonic acid, triethanolamine or an adduct of a polyalkylenepolyamine with from 2 to 10 moles of ethylene oxide.

3. An aqueous treatment liquor, having a pH of 10 or more, which is used for textile goods consisting of or containing cellulose and contains (assuming a liquor ratio of 1:1), from 0.2 to 15% by weight, based on the liquor, of an agent as claimed in claim 1 or 2.

* * * * *